United States Patent [19]

Ripamonti

[11] 4,432,517

[45] Feb. 21, 1984

[54] CIRCUIT FOR DETECTING UNBALANCE OF THE TRACTION CURRENT IN A TRACK CIRCUIT

[75] Inventor: Paolo Ripamonti, Genoa, Italy

[73] Assignee: ANSALDO S.p.A., Genoa, Italy

[21] Appl. No.: 250,862

[22] Filed: Apr. 3, 1981

[30] Foreign Application Priority Data

Apr. 18, 1980 [IT] Italy ..... 12513 A/80

[51] Int. Cl.[3] ..... G08B 21/00

[52] U.S. Cl. ..... 246/28 F; 246/1 C; 246/34 B; 340/47; 340/651; 340/652

[58] Field of Search ..... 246/28 F, 28 R, 34 B, 246/34 C, 1 C; 340/651, 652, 47

[56] References Cited

U.S. PATENT DOCUMENTS

| | | | |
|---|---|---|---|
| 2,277,466 | 3/1942 | Thompson | 246/34 C |
| 2,311,034 | 2/1943 | Dodd | 246/28 F |
| 3,387,064 | 6/1968 | Joy et al. | 340/652 |
| 3,870,952 | 3/1975 | Sibley | 246/28 F |
| 3,970,271 | 7/1976 | Auer et al. | 246/28 R |

*Primary Examiner*—Glen R. Swann, III

*Attorney, Agent, or Firm*—Robert E. Burns; Emmanuel J. Lobato; Bruce L. Adams

[57] ABSTRACT

In order to prevent a false signal being given in a circuit arrangement for detecting the presence of rolling stock on a track section, when a rail is grounded or fractured, a detecting circuit (31) is provided for detecting unbalance of the traction current. The unbalance detecting circuit is for association with a transmitter (20) for transmitting a track circuit current and an associated receiver (21). The unbalance detecting circuit has two current sensors (TA) which are connected to the ends of the rails (1, 2) adjacent to the receiver (21) for transmitting respective signals to the unbalance detecting circuit (31), and the unbalance detecting circuit transmits the track circuit signal to the receiver only when the signals detected by the current sensors are equal or when their difference is such as not to cause undue excitation of the receiver, and a pole change switch (30) for connection between the track circuit current transmitter and the ends of the rails associated therewith.

4 Claims, 5 Drawing Figures

CIRCUIT FOR DETECTING UNBALANCE OF THE TRACTION CURRENT IN A TRACK CIRCUIT

BACKGROUND OF THE INVENTION

The present invention relates to a circuit for detecting unbalance of the traction current in a track circuit of the type comprising a track section which is short-circuited by rolling stock in such a manner as to form an independent track circuit, each such section being provided with a transmitter for transmitting a track circuit current and an associated receiver. The invention extends to a circuit arrangement for detecting the presence of rolling stock on a track section, comprising the detecting circuit, the transmitter and the receiver, and also to a section of railway track connected to such a circuit arrangement.

The traction current for locomotives equipped with electronic control has a harmonic content which under determined conditions is similar to the actual signal of the track circuit.

The traction current and the actual current of the track circuit both pass simultaneously through the track circuit, by means of which data is transmitted. Under conditions of substantial unbalance between the two rails, due for example to accidental grounding or fracture of a rail, or to disconnection of the continuity braid or strip between two rails, the traction current can give rise to potential differences across the track circuit receiver which is equivalent to the signal of the track circuit, and thus cause undue excitation of the relays in the receiver or blocking section.

One condition of the track circuit which would cause unreliability is the presence of the train on a track in which there is a rail fracture at a point behind the train. Under such a condition, the traction current, with a high harmonic content generated by the rolling stock or substations and in the presence of beats between the various frequencies, is associated with one half of the receiver (inductive connection in this case), and can therefore produce across the receiver a voltage equivalent to the track circuit current. This can cause the undue excitation of the track relay controlling the signal in the block section occupied, consequently setting the signal at "go" (green) whereas it should remain at "stop" (red) for obvious safety reasons.

OBJECT OF THE INVENTION

The detecting circuit of the invention decodes the track circuit signal by monitoring the balance between the current in the two rails forming part of the track circuit. The detecting circuit raises the signal/disturbance ratio and makes the track circuit receiver less sensitive to the disturbance caused by the traction current harmonics. The detecting current can be used in track circuits with coded and uncoded currents of any frequency, possibly using inductive connections.

BRIEF DESCRIPTION OF THE DRAWINGS

The invention will be further described, by way of example, with reference to the accompanying drawings, in which.

DESCRIPTION OF PREFERRED EMBODIMENT

Figure 1:
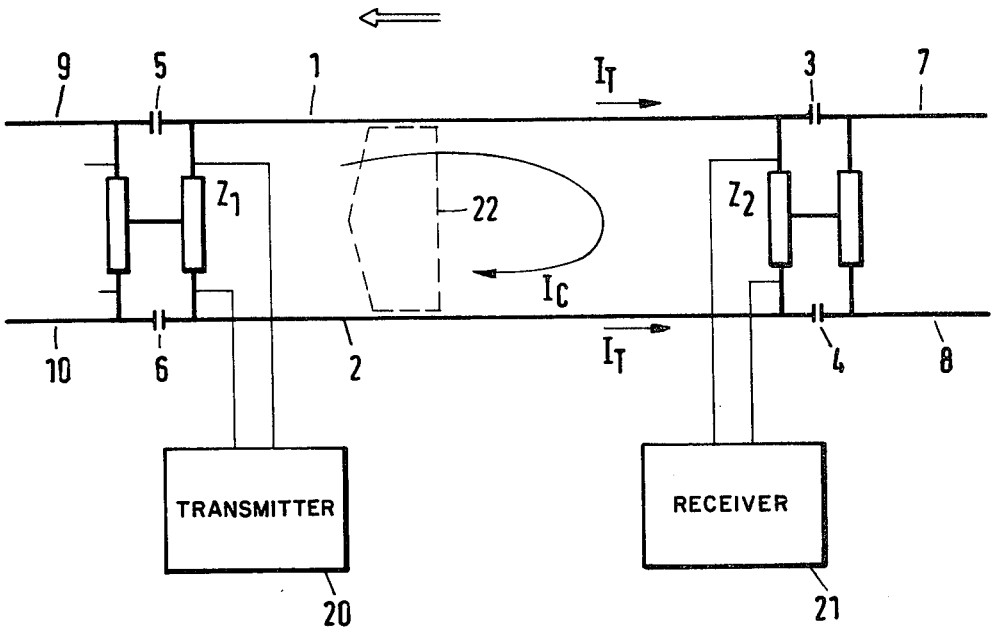
Fig.1 PRIOR ART
FIG. 1 is a schematic representation of a track circuit of conventional type fitted with track impedances and insulating joints.

The large arrow shown in FIG. 1 shows the direction of movement of the train.

The track circuit illustrated in FIG. 1 comprises two rails or rail lengths 1 and 2 through which the balanced or equal traction currents IT flow in the same direction. The two rail lengths 1 and 2 are insulated at 3, 4, 5 and 6 from the adjacent rail lengths 7, 8, 9 and 10.

Track impedances Z1 and Z2 are used in known manner for the passage of the traction current from one section to another, and are connected to respective end portions of the rails 1, 2. The terminals of the first impedance Z1 are fed by the transmitter 20 of the automatic block system.

The receiver 21 of the automatic block system is connected across the second impedance Z2. When the section under consideration is not occupied, the current IC of the track circuit determines a signal across Z2 and thus across the receiver 21 which sets track signal A (see FIG. 2) at "go". If however the section in question is occupied, as indicated diagrammatically by the dashed profile 22 representing a train, the track circuit current is short-circuited between Z1 and the Z2 by the axles of the train 22.

Figure 2:
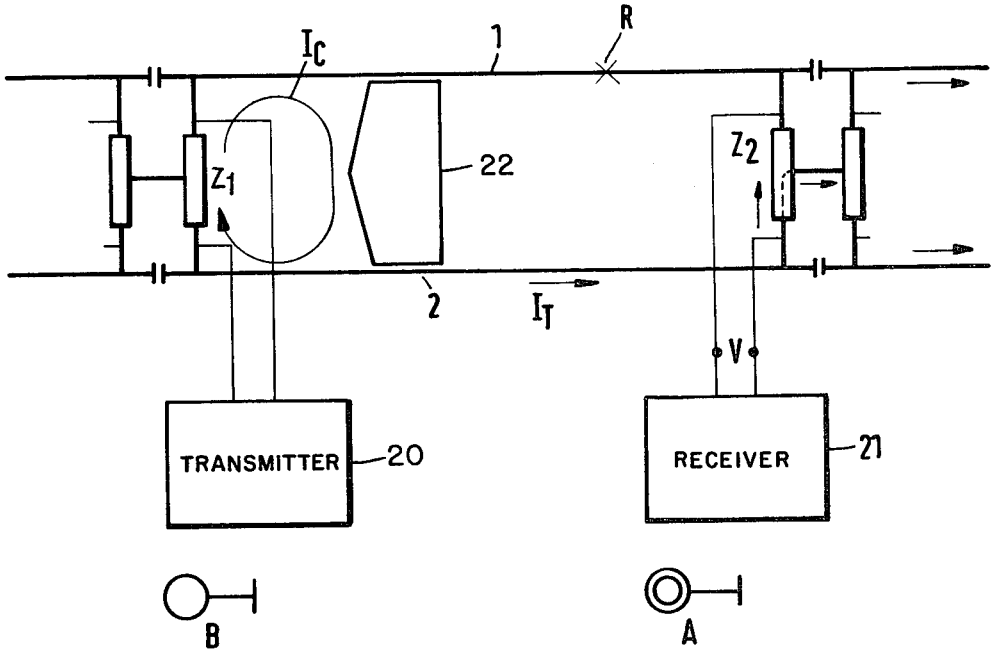
Fig. 2 PRIOR ART
FIG. 2 shows the same track circuit diagram with the supposition of a fault represented by a rail fracture.

Thus in that part of the section between the axles of the train 22 and the receiver impedance Z2 the track current is zero, and only the traction current IT passes along the rails 1 and 2. The receiver 21 notes the absence of a track current signal across Z2, and thus indicates that the section is occupied. This is because the two currents IT in the rails 1 and 2 are balanced or equal, and do not give rise to a voltage drop across Z2. This happens under normal operating conditions. If, as illustrated in FIG. 2, the section formed by the rails 1 and 2 is occupied but for example one of the two rails is interrupted at R, the track circuit current is again short-circuited between Z1 and Z2 by the axles of the train 22. However, the traction current IT passes along the rail 2 between the axles 22 and the receiver Z2, whereas no current passes along the rail 1 because of the interruption R. The traction current is associated with only one half of the impedance Z2, and thus determines across Z2 a voltage which is other than zero and which can give rise to an erroneous signal at the receiver 21.

Figure 3:
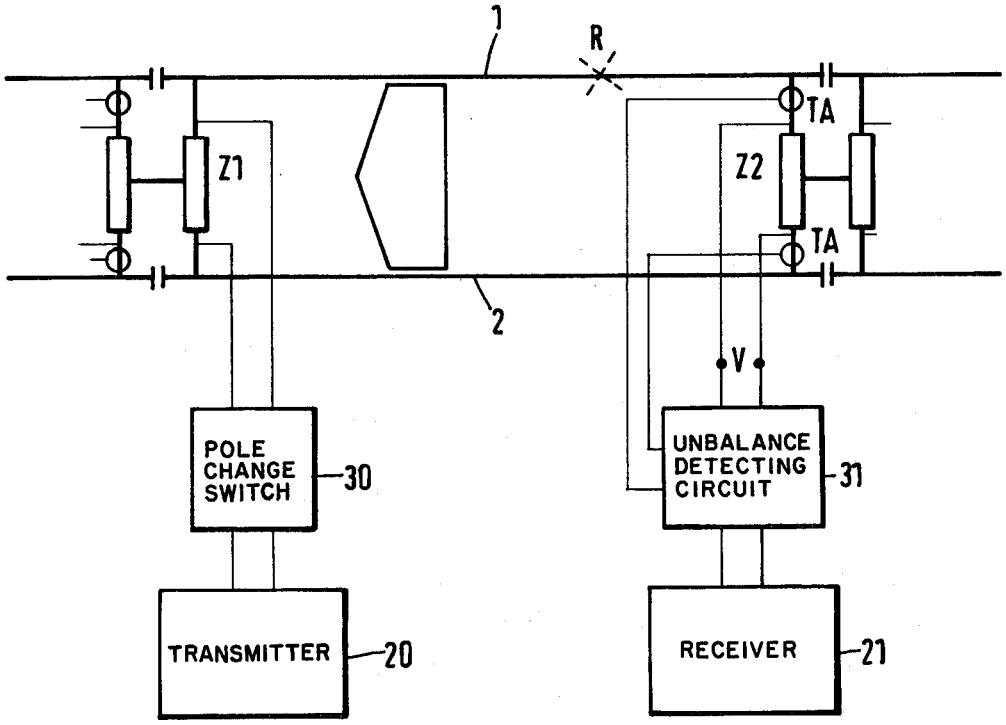
FIG. 3 shows a track circuit in the same situation as that of FIG. 2, but with an unbalance detecting circuit according to the invention connected.

This drawback is obviated as illustrated with reference to FIG. 3, which illustrates the abnormal situation illustrated in FIG. 2.

The transmitter 20 is connected across the impedance Z1 by way of a pole change switch 30 for the track circuit current.

Two current sensors in the form of transformers TA are connected across the impedance Z2, and feed signals to an unbalance detecting circuit 31 which are proportional to the two traction currents which pass along the two rails 1 and 2. The voltage drop of Z2 caused by the track circuit current also reaches the unbalance detector 31.

The detecting circuit 31 transmits to the receiver 21 the signal taken from the terminals of the impedance Z2 only when the currents sensed by TA are equal to each other. If the currents sensed by TA are different, for example as the result of an interruption R, the unbalance detecting circuit 31 transfers no voltage to the receiver 21, and thus the receiver 21 transmits a "stop" signal.

The function of the pole change switch 30 is to cyclically reverse the direction of the track circuit current so that if the "all clear" condition exists and the circuit is complete, then the average currents sensed by the current transformers TA can be equal. In this respect, if the sign of the track circuit current were constant, the current sensed by the current trasformer TA connected to the rail 1 and that connected to the rail 2 would be different.

The above description also applied to track circuits without insulating joints. In this case the current sensors must be coupled to the rail in such a manner as to lie in the magnetic field generated by the current passing along the rail.

Figure 4:
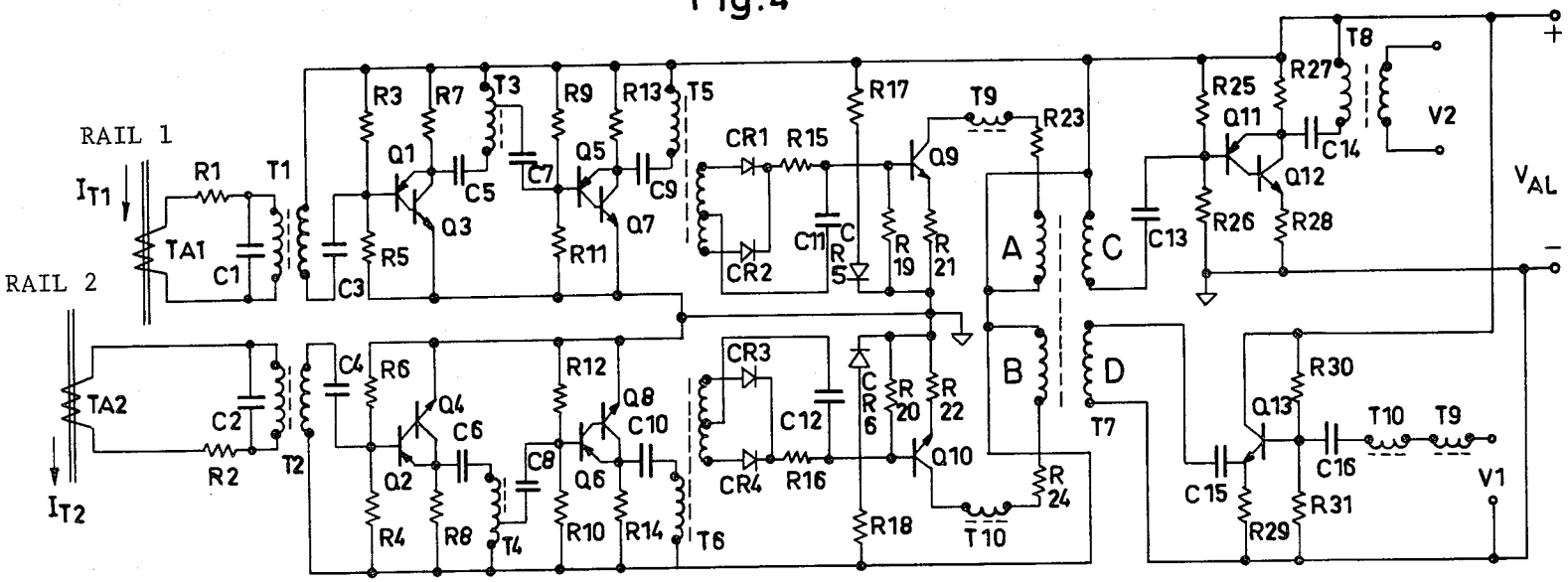
FIG. 4 shows one construction of the detecting circuit.

With particular reference to FIG. 4, this shows the electrical circuit of a detecting circuit according to the invention. The current transformers TA feed, with signals proportional to the harmonic traction current IT, two equal sections of the detecting circuit in the form of filters tuned to a suitable frequency. In this manner, the traction current is monitored by measuring the harmonic at a frequency equal to the frequency of the track circuit signal. The transformers T1 and T3 of one section and T2 and T4 of the other section, together with the circuits connected thereto, comprising the transistors Q1 to Q8, constitute the filter. The transformers T5 and T6 and the diodes CR1 to CR4 transfer continuous signals proportional to the currents IT1 and IT2 to the transistors Q9 and Q10. These signals are equal if the currents in the two rails are balanced, and there are thus two equal currents in the windings A and B of the transformer T7 which determine a resultant magneto-motive force which is equal to zero. Under such a condition, the signal V1 across the ends of the track impedance Z2 (FIG. 3) and transferred through Q13 to the winding D of T7, determines an equivalent signal in the output winding C.

The circuit comprising the transistors Q11 and Q12 and the transformer T8 supplies the receiver with a signal V2 equivalent to the signal V1.

If the monitored harmonic is not present in the traction current, then there is no track circuit current of the same frequency. By continuously monitoring this current, the device operates in a fail-safe manner. If the currents in the two rails are unbalanced beyond a determined limit, the signals present in the two sections of the unbalance detecting circuit are different and determine in the transformer T7 a resultant magneto-motive force such as to saturate the magnetic material.

Consequently, the signal V1 is not transferred to the output of the unbalance detecting circuit. The receiver is not supplied, and the corresponding signal is set at "stop".

Figure 5:
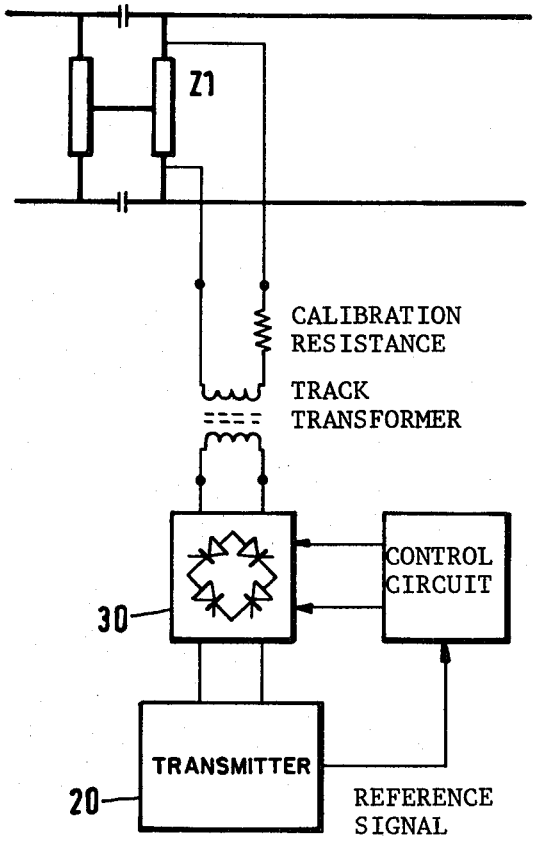
FIG. 5 shows the connection of the pole change switch to the track circuit.

With particular reference to FIG. 5, this shows the connection of the pole change switch into the transmitter for the track circuit signal.

The pole change switch is essentially a controlled diode bridge piloted by a control circuit. In the case of a coded track circuit, the coded signal is the reference signal which pilots the control circuit. In the case of a non-coded track circuit, a code signal is generally present in the transmission and can be used to pilot the control circuit. The pole change switch is connected to the ouput of the transmitter and supplies the existing track transformer, which is connected to the ends of the track impedance Z1. Although the above description refers to having the unbalance detecting circuit physically associated with the track section, the unbalance detecting circuit, together if desired with other items such as the transmitter and receiver, could be mounted on rolling stock such as a locomotive. In general, if the unbalance detecting circuit is mounted on the locomotive, the receiver of the circuit arrangement will be mounted on the locomotive.

Although for descriptive reasons the present invention has been based on that described and illustrated heretofore with particular reference to the accompanying Figures, various modifications can be made.

What I claim is:

1. A device for detecting unbalance of the traction current in a track circuit of the type comprising a track section which is short-circuited by rolling stock, there being a transmitter for transmitting a track circuit signal current and an associated receiver characterized in that the unbalance detecting device comprises two current sensors for coupling to respective rails of the track section, an unbalance detecting circuit for receiving from the current sensors respective signal currents in the respective rails for transmitting track circuit signal currents to the receiver when the signal currents detected by the current sensors are equal and responsive to any detected unbalanced currents of a given frequency and magnitude of unbalance effective to render the unbalance detecting circuit effective to preclude transmission to the receiver, and a pole change switch for connection between the track circuit current transmitter and the rails associated therewith for alternately changing the direction of the track circuit signal current through the track circuit to render the track circuit signal current balanced.

2. The unbalance detecting device of claim 1, characterized in that the unbalance detecting circuit is provided with filter means tunable to the actual frequency used for the track circuit signal current.

3. An arrangement for detecting the presence of rolling stock on a track section, comprising the unbalance detecting device of claim 1 or 2, a transmitter for transmitting a track circuit signal current, and an associated receiver.

4. The arrangement of claim 3 in combination with a section of track coupled to the arrangement.

* * * * *